US009334700B2

(12) United States Patent
Hanson et al.

(10) Patent No.: US 9,334,700 B2
(45) Date of Patent: May 10, 2016

(54) REVERSE CEMENTING VALVE

(75) Inventors: Andrew James Hanson, Edmonton (CA); Joseph Robert Marcin, Spruce Grove (CA); Randal Brent Biedemann, Calgary (CA); Damian Leonard Ward, Calgary (CA); Clayton R. Andersen, Houston, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 913 days.

(21) Appl. No.: 13/439,207

(22) Filed: Apr. 4, 2012

(65) Prior Publication Data

US 2013/0264068 A1 Oct. 10, 2013

(51) Int. Cl.

| | |
|---|---|
| ***E21B 34/08*** | (2006.01) |
| ***E21B 21/10*** | (2006.01) |
| ***E21B 33/13*** | (2006.01) |
| *E21B 34/00* | (2006.01) |

(52) U.S. Cl.

CPC ..... *E21B 21/103* (2013.01); *E21B 33/13* (2013.01); *E21B 34/08* (2013.01); *E21B 2034/007* (2013.01); *Y10T 137/7069* (2015.04)

(58) Field of Classification Search

CPC ..... E21B 33/14; E21B 34/102; E21B 34/08

See application file for complete search history.

(56) References Cited

U.S. PATENT DOCUMENTS

| | | | | |
|---|---|---|---|---|
| 2,675,082 | A | 4/1954 | Hall | |
| 3,273,650 | A * | 9/1966 | Alexander et al. | 166/317 |
| 4,044,829 | A * | 8/1977 | Jessup et al. | 166/264 |
| 4,391,329 | A | 7/1983 | Gallus | |
| 4,452,638 | A | 6/1984 | Gallus | |
| 4,674,573 | A | 6/1987 | Bode | |
| 4,949,788 | A | 8/1990 | Szarka et al. | |
| 5,494,107 | A | 2/1996 | Bode | |
| 5,890,538 | A | 4/1999 | Beirute et al. | |
| 6,244,342 | B1 | 6/2001 | Sullaway et al. | |
| 6,802,373 | B2 | 10/2004 | Dillenbeck et al. | |
| 6,802,374 | B2 | 10/2004 | Edgar et al. | |
| 6,920,929 | B2 | 7/2005 | Bour | |
| 7,013,971 | B2 | 3/2006 | Griffith et al. | |
| 7,066,256 | B2 | 6/2006 | Dillenbeck et al. | |
| 7,204,304 | B2 | 4/2007 | Rogers et al. | |
| 7,225,871 | B2 | 6/2007 | Rogers et al. | |
| 7,252,147 | B2 | 8/2007 | Badalamenti et al. | |
| 7,252,152 | B2 | 8/2007 | LoGiudice et al. | |
| 7,270,183 | B2 | 9/2007 | Bour et al. | |
| 7,281,584 | B2 * | 10/2007 | McGarian et al. | 166/323 |

(Continued)

OTHER PUBLICATIONS

Canadian Office Action dated Feb. 13, 2015, for Canadian Patent Application No. 2,775,330.

*Primary Examiner* — David Andrews

(74) *Attorney, Agent, or Firm* — Patterson & Sheridan, L.L.P.

(57) ABSTRACT

A method and apparatus for conducting a reverse flow operation. The apparatus may be lowered into a wellbore on a work string, and includes an opening device, a closing device, and a locking device disposed in a housing. Pressurized fluid supplied through the work string may actuate the opening device to open fluid flow through ports in the housing. Pressurized fluid from the annulus may be supplied through the port in the reverse flow direction to actuate the locking device to enable fluid flow up through the work string back to the surface, and to release the closing device. Pressurized fluid supplied through the work string may actuate the closing device to close fluid flow through the ports in the housing.

27 Claims, 6 Drawing Sheets

(56) References Cited

U.S. PATENT DOCUMENTS

| | | | |
|---|---|---|---|
| 7,284,608 | B2 | 10/2007 | Reddy et al. |
| 7,290,611 | B2 | 11/2007 | Badalamenti et al. |
| 7,290,612 | B2 | 11/2007 | Rogers et al. |
| 7,293,609 | B2 | 11/2007 | Dealy et al. |
| 7,303,008 | B2 | 12/2007 | Badalamenti et al. |
| 7,303,014 | B2 | 12/2007 | Reddy et al. |
| 7,322,412 | B2 | 1/2008 | Badalamenti et al. |
| 7,357,181 | B2 | 4/2008 | Webb et al. |
| 7,389,815 | B2 | 6/2008 | Badalamenti et al. |
| 7,392,840 | B2 | 7/2008 | Griffith et al. |
| 7,401,646 | B2 | 7/2008 | Badalamenti et al. |
| 7,404,440 | B2 | 7/2008 | Reddy et al. |
| 7,409,991 | B2 | 8/2008 | Reddy et al. |
| 7,451,817 | B2 | 11/2008 | Reddy et al. |
| 7,503,399 | B2 | 3/2009 | Badalamenti et al. |
| 7,527,104 | B2 | 5/2009 | Branch et al. |
| 7,533,728 | B2 | 5/2009 | Winslow et al. |
| 7,533,729 | B2 | 5/2009 | Rogers et al. |
| 7,540,325 | B2 | 6/2009 | Livingstone |
| 7,597,146 | B2 | 10/2009 | Winslow et al. |
| 7,614,451 | B2 | 11/2009 | Blaschke et al. |
| 7,621,336 | B2 | 11/2009 | Badalamenti et al. |
| 7,621,337 | B2 | 11/2009 | Badalamenti et al. |
| 7,654,324 | B2 | 2/2010 | Chase et al. |
| 7,712,527 | B2 | 5/2010 | Roddy |
| 7,938,186 | B1 | 5/2011 | Badalamenti et al. |
| 8,104,505 | B2 | 1/2012 | O'Brien et al. |
| 8,162,047 | B2 | 4/2012 | Chase et al. |
| 2003/0029611 | A1 | 2/2003 | Owens |
| 2006/0219407 | A1 | 10/2006 | Livingstone |
| 2007/0095533 | A1 | 5/2007 | Rogers et al. |
| 2008/0011482 | A1 | 1/2008 | Badalamenti et al. |
| 2008/0060814 | A1 | 3/2008 | Badalamenti et al. |
| 2008/0135248 | A1 | 6/2008 | Talley et al. |
| 2008/0196889 | A1 | 8/2008 | Bour et al. |
| 2009/0260816 | A1 | 10/2009 | Webb et al. |
| 2012/0322698 | A1 | 12/2012 | Dealy et al. |

* cited by examiner

REVERSE CEMENTING VALVE

BACKGROUND OF THE INVENTION

1. Field of the Invention

Embodiments of the invention generally relate to apparatus and methods for performing reverse flow (e.g. cementing) operations. In particular, embodiments of the invention relate to a reverse flow (e.g. cementing) valve.

2. Description of the Related Art

One or more casings may be cemented in a wellbore by utilizing what is known as a reverse cementing method. The reverse cementing method comprises pumping conventionally mixed cement into the annulus between the casing string and an existing string or an open hole section of the wellbore. As the cement is pumped down the annular space, drilling or other wellbore fluids ahead of the cement are displaced around the lower ends of the casing string and up the inner bore of the casing string and out at the surface. A predetermined amount of cement is pumped into the annulus to ensure a good quality cement job.

In some wellbore completion operations, such as a multi-zone open hole (MZOH) completion, a work string comprising a fracturing sleeve and one or more packers may be used to conduct a fracturing operation to treat or stimulate the formation surrounding the well. It is generally desired to cement the vertical section of the wellbore above the area where the fracturing operation is to take place, without passing any cement through the fracturing sleeve or packers. The cementing operation should be done without creating additional leak paths through the work string, or compromising the work string integrity above the packers. The operation should also be done without the requirement for any drill-out operations between cementing and fracturing, which increase the time and cost of the overall completion operation. Other operational considerations include the necessity to displace drilling or other wellbore fluids prior to or while cementing, and the desire to initiate operation of one or more tools on the work string by deploying a single ball into the flow through the work string, and then use only fluid flow (e.g. no intervention devices or further actuation devices such as balls) for additional operational stages.

Historically, although reverse cementing has been used to keep cement out of the work string, prior reverse cementing methods typically either create a leak path in the work string for fluid flow such as with use of a port collar, or cannot be run with fracturing sleeves in place. Stage collars have been used, but they require a drill-out operation after use and are not as robust as standard threaded connections. Another less than ideal solution has been to cement the entire wellbore, and to use fracturing sleeves that require mechanical intervention for actuation rather than standard ball actuated sleeves.

Therefore, there exists a need for new and improved methods and apparatus for conducting reverse flow or cementing operations.

SUMMARY OF THE INVENTION

In one embodiment, a valve assembly may comprise an outer housing having one or more ports; a closing sleeve movable in one direction using pressurized fluid to close fluid flow through the ports; and a locking device operable to temporarily secure the closing sleeve to the outer housing, wherein the locking device is movable in an opposite direction using pressurized fluid to release the closing sleeve from engagement with the outer housing.

In one embodiment, a method of conducting a wellbore operation may comprise providing a valve assembly for operation in a wellbore using a work string; moving an opening sleeve of the valve assembly using pressurized fluid supplied through the work string to open fluid flow through one or more ports; moving a locking device of the valve assembly using pressurized fluid supplied from an annulus surrounding the valve assembly through the one or more ports to release a closing sleeve of the valve assembly; and moving the closing sleeve using pressurized fluid supplied through the work string to close fluid flow through the one or more ports.

In one embodiment, a valve assembly may comprise an outer housing having one or more ports; a closing sleeve movable in one direction from an open position to a closed position to close fluid flow through the ports; and a locking device operable to temporarily secure the closing sleeve in the open position and movable in an opposite direction to release the closing sleeve for movement to the closed position.

In one embodiment, a valve assembly may comprise an outer housing having one or more ports; a closing sleeve movable from an open position to a closed position to close fluid flow through the ports, the closing sleeve temporarily secured in the open position using a fixing member; and a locking device temporarily retaining the fixing member to maintain the closing sleeve in the open position, wherein movement of the locking device in one direction releases the fixing member, thereby enabling the closing sleeve to move in an opposite direction towards the closed position.

In one embodiment, a valve assembly may comprise an outer housing having one or more ports; a closing sleeve movable from an open position to a closed position to close fluid flow through the ports; and a locking device operable to temporarily disallow movement of the closing sleeve to the closed position, wherein the locking device is movable in one direction to allow movement of the closing sleeve in an opposite direction to the closed position.

In one embodiment, a valve assembly may comprise an outer housing having one or more ports; a closing sleeve having an open position in which fluid flow through the ports is permitted and a closed position in which fluid flow through the ports is prevented; and a locking device temporarily retaining the closing sleeve in the open position, wherein the locking device is movable in one direction to release the closing sleeve, and wherein the closing sleeve moves in an opposite direction from the open position to the closed position.

BRIEF DESCRIPTION OF THE DRAWINGS

So that the manner in which the above recited features of the invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Embodiments of the invention relate to a reverse flow or cementing valve assembly 100 for use in a (open hole or cased) wellbore. The valve assembly 100 may be disposed on a work string below one or more fracturing sleeves and/or packers operable to conduct a fracturing operation in a wellbore. One or more float valves (such as one-way check valves) may also be coupled to the work string below the valve assembly 100 for allowing fluid flow out of the work string and into the wellbore, while preventing fluid flow from the wellbore back into the work string. The work string may be run into the wellbore while circulating fluid forward through the work sting and into the wellbore, which is generally done to displace any drilling or other wellbore fluids with a desired fluid, such as a conditioning fluid or a fracturing fluid. This forward circulation and displacement of wellbore fluids is also known as conditioning the well. In one embodiment, the work string and valve assembly 100 may be run-in and positioned at the desired location within the wellbore, and then fluid may be circulated therethrough to condition the well. The valve assembly 100 may be positioned and operable in a vertical, lateral, or horizontal section of the wellbore.

Figure 1:
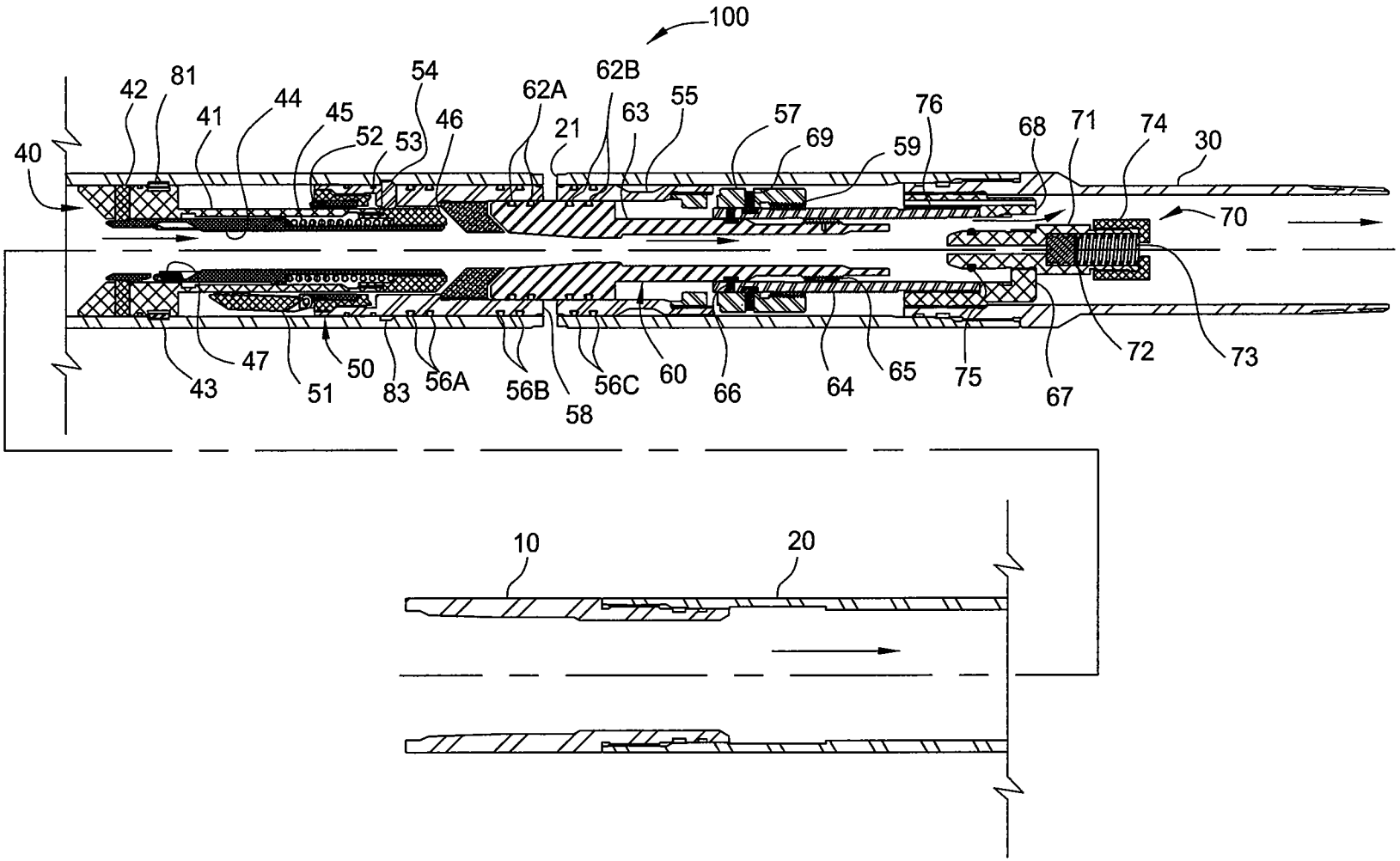
FIG. 1 is a sectional view of a valve assembly in a run-in position according to one embodiment.

FIG. 1 illustrates a sectional view of the valve assembly 100 in a run-in position, e.g. when lowered on the work string into the wellbore. The valve assembly 100 includes an upper sub 10, an outer housing 20, and a lower sub 30. The upper sub 10 may be coupled to the work string, which may comprise a coiled or threaded tubing string. The outer housing 20 may be coupled at one end to the upper sub 10, and at an opposite end to the lower sub 30, via a threaded/sealed connection. One or more ports 21 are disposed through the outer housing 20 for providing fluid communication between the interior and the exterior of the housing 20, and particularly for providing fluid communication between the inner bore of the valve assembly 100 (and thus the work string) and the surrounding annulus as further described below.

The outer housing 20 may support a locking device 40, a closing device 50, an opening device 60, and a hydraulic lock compensation assembly 70. The locking device 40 is operable to prevent the valve assembly 100 from being actuated prematurely into the final closed position illustrated in FIG. 6. The closing device 50 is operable to actuate the valve assembly 100 into the final closed position. And the opening device 60 is operable to actuate the valve assembly 100 into an open position, illustrated in FIG. 2, to permit reverse circulation through the valve assembly 100, illustrated in FIGS. 3 and 4, to conducting a reverse flow (e.g. cementing) operation as further described below.

Referring to FIG. 1, as the work string is run into the wellbore, fluid may be supplied through the valve assembly 100 in a forward flowing direction and out into the wellbore. In particular, fluid may flow through the upper sub 10 and a flapper valve 47 of the locking device 40. Fluid may then flow through an opening sleeve member 63 bore and one or more ports 68 of a lower housing 67 of the opening device 60, and out through the lower sub 30.

The locking device 40 may further include an inner sleeve member 44 for supporting the flapper valve 47, and an upper housing 41 for supporting the sleeve member 44. The sleeve member 44 may be biased by a biasing member 45 (such as a spring), which is disposed between the sleeve member 44 and a retaining member 46 coupled to the lower end of the upper housing 41. One or more dog (fixing) members 42 are movably disposed through the upper end of the upper housing 41, and temporarily secure the sleeve member 44 in the upper housing 41. A compressible ring member 43 (or other similar type of detent mechanism) may be coupled to the upper housing 41 and extends into a recess 81 of the outer housing 20. The ring member 43 resists movement between the upper housing 41 and the outer housing 20.

Figure 3:
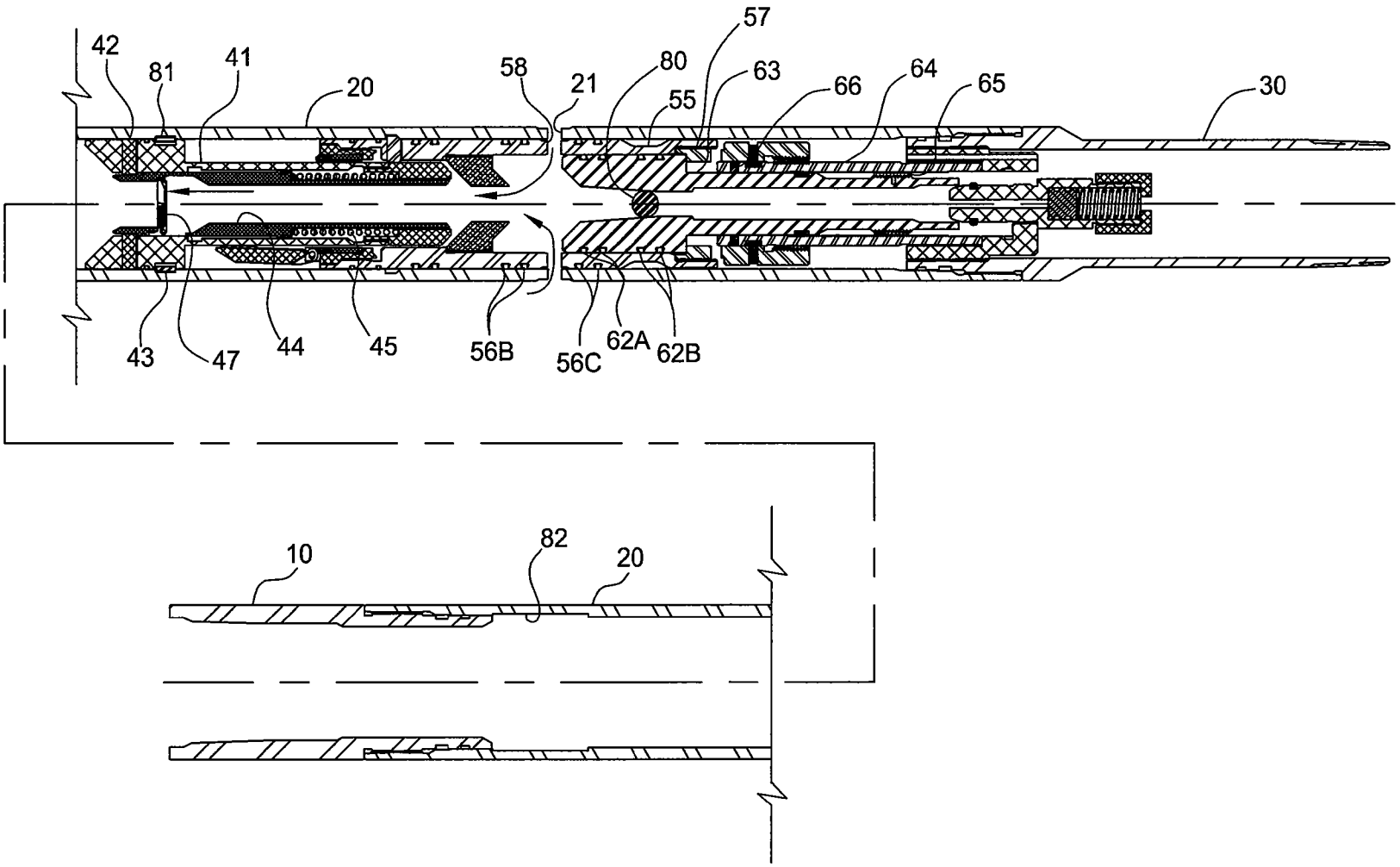
FIG. 3 is a sectional view of the valve assembly in a reverse circulation position prior to actuation of a locking device according to one embodiment.

In one embodiment, the flapper valve 47 may be a tri-flapper valve assembly, and may permit fluid flow in one direction while preventing or substantially restricting fluid flow in the opposite direction. The flapper valve 47 may be biased into a closed position by a spring or other similar biasing member. Pressurized fluid flow in one direction may overcome the bias of the spring to open and permit fluid flow through the flapper valve 47 as illustrated in FIG. 1. Pressurized fluid flow in the opposite direction acts with the bias of the spring to maintain the flapper valve 47 in a closed position to prevent or substantially restrict fluid flow in the opposite direction as illustrated in FIG. 3. Other flapper valves, check valves, and/or one-way valves known in the art may be used with the embodiments described herein.

The closing device 50 may also include another flapper valve 51, and a flapper valve seat 52 coupled to a closing sleeve member 55 by a retaining member 53. The flapper valve 51 is held in an open position by the upper housing 41 of the locking device 40. One or more dog (fixing) members 54 are movably disposed through an upper end of the closing sleeve member 55, and extend into a recess 83 in the outer housing 20 to temporarily secure the closing sleeve member 55 to the outer housing 20. The dog members 54 are temporarily secured in the recess 83 by the upper housing 41 and/or the retaining member 46 of the locking device 40. One or more seals 56A, 56B, 56C, such as o-rings, are coupled to the closing sleeve member 55 and sealingly engage the outer housing 20. The closing sleeve member 55 includes one or more ports 58 that are aligned with and/or are in fluid communication with the ports 21 of the outer housing when the valve assembly 100 is in the run-in position. A retaining member 57 may be threadedly coupled to the lower end of the closing sleeve member 55. The retaining member 57 may also be releasably coupled to a ratchet member 64 by one or more releasable members 69, such as shear screws. A ratchet ring 59 may be disposed between the retaining member 57 and the ratchet member 64. The ratchet ring 59 engages teeth formed on the inner surface of the retaining member 57 and teeth formed on the outer surface of the ratchet member 64 to permit relative movement between the retaining and ratchet members in one direction, while preventing movement in the opposite direction. Upon release of the releasable members 69, the retaining member 57 and thus the closing sleeve member 55 are moveable in a downward direction to close fluid communication through the ports 21 of the outer housing 20.

The opening device 60 may further include one or more seals 62A, 62B, such as o-rings, coupled to the opening sleeve member 63 that sealingly engage the closing sleeve member 55. The ratchet member 64 may be releasably coupled to the opening sleeve member 63 by one or more releasable members 66, such as shear screws. A ratchet ring 65 may be disposed between the opening sleeve member 63 and the ratchet member 64. The ratchet ring 65 engages teeth formed on the outer surface of the opening sleeve member 63 and teeth formed on the inner surface of the ratchet member 64 to permit relative movement between the sleeve and ratchet members in one direction, while preventing movement in the opposite direction. Upon release of the releasable members 66, the opening sleeve member 63 is moveable in a downward direction to open fluid communication through the ports 21 of the outer housing 20 and the ports 58 of the closing sleeve member 55. The ratchet member 64 may be supported at a lower end by the lower housing 67, which may be threadedly coupled to the lower sub 30.

Figure 6:
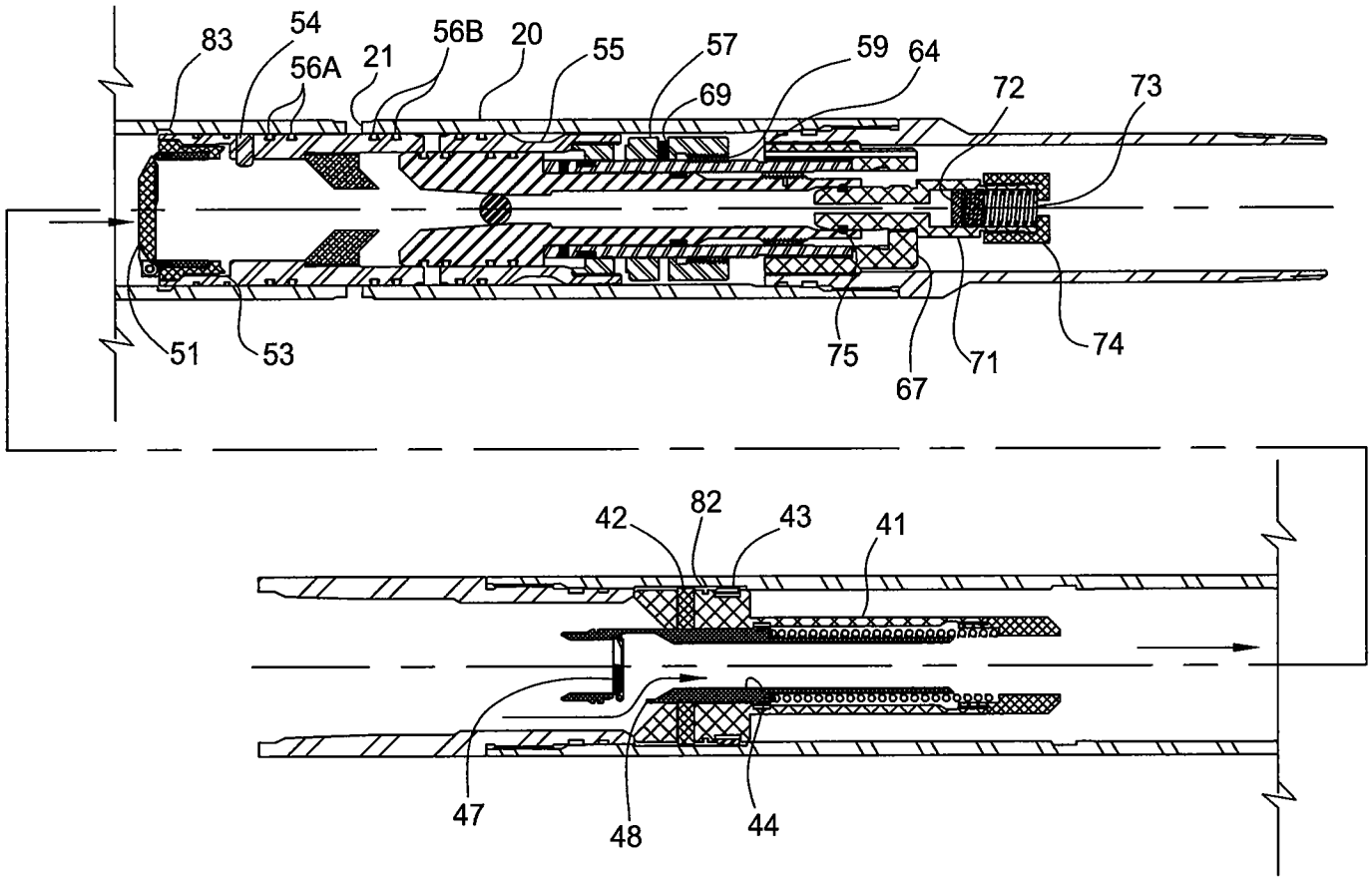
FIG. 6 is a sectional view of the valve assembly in a final closed position according to one embodiment.

The hydraulic lock compensation assembly 70 may include a mandrel 71 threadedly coupled to the lower housing 67, and a plug member 72 and a biasing member 73 (such as a spring) secured in the mandrel 71 by a retaining member 74. The biasing member 73 biases the plug member 72 against an inner shoulder of the mandrel 71, which includes a bore in fluid communication with outer housing 20. The plug member 72 is sealingly disposed in the mandrel 71 and prevents fluid flow through the mandrel 71. The hydraulic lock compensation assembly 70 may be provided to compensate for any hydraulic lock that may occur within the valve assembly 100, such as when actuated into the final closed position and the opening sleeve member 63 is moved downward and sealingly engages one or more seals 75 (such as o-rings) coupled to the mandrel 71 as illustrated in FIG. 6. The locked hydraulic volume moves downward and forces the plug member 72 against the bias of the biasing member 73 to compensate for any potential hydraulic lock conditions/forces within the valve assembly 100 which may prevent movement of the closing sleeve member 55 as further illustrated in FIG. 6. The lower housing 67 may also include one or more ports 76 for allowing fluid flow out of the outer housing 21 to prevent fluid locking of the opening and/or closing sleeve members 63, 55.

Figure 2:
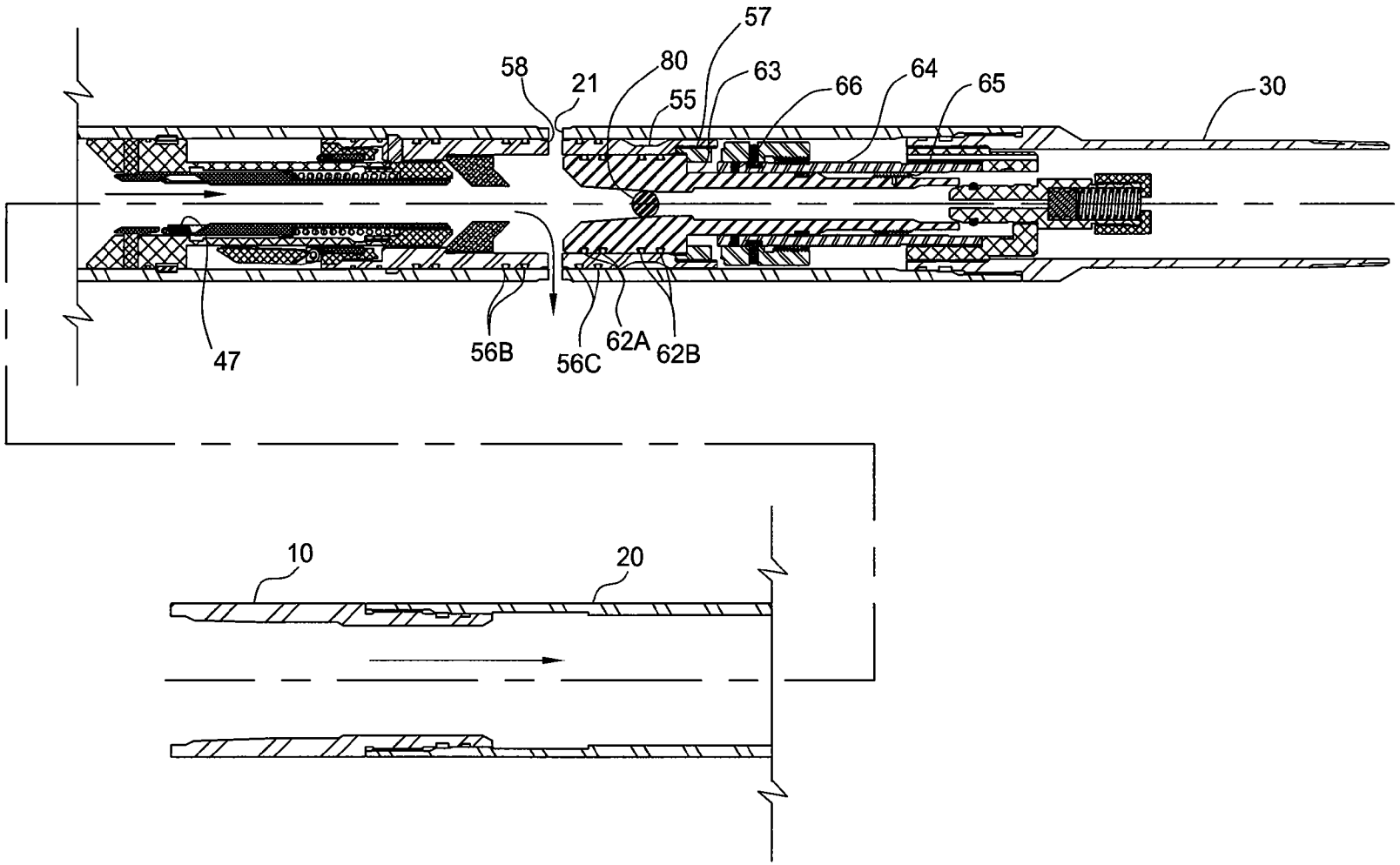
FIG. 2 is a sectional view of the valve assembly in an open position according to one embodiment.

FIG. 2 illustrates the valve assembly 100 in an open position. When the assembly is located at the desired location in the wellbore, a closure member 80, such as a ball, dart, or other similar closure or plug-type member, may be dropped from surface through the work string. The closure member 80 may flow through the flapper valve 47 and land on a seat portion of the opening sleeve member 63 to close fluid flow through the bore of the opening sleeve member 63. The seat portion of the opening sleeve member 63 may be tapered so that the closure member 80 can be wedged and secured in the sleeve member by the pressurized fluid to prevent inadvertent removal of the closure member 80, such as when the valve assembly 100 is positioned horizontally and/or when reverse circulating through the valve assembly 100. Pressurized fluid above the closure member 80 may also be used to force and release the releasable member 66 to move the opening sleeve member 63 in a downward direction. As the opening sleeve member 63 is moved downward, the ratchet ring 65 moves along the teeth disposed on the inner surface of the ratchet member 64 and prevents the opening sleeve member 63 from moving back in the opposite or upward direction. The opening sleeve member 63 may be moved until it engages a shoulder of the retaining member 57. In the position illustrated in FIG. 2, the one or more seals 62A, 62B and the opening sleeve member 63 are moved to open fluid communication through the ports 58 of the closing sleeve member 55 and the ports 21 of the outer housing 20, thereby opening fluid communication to the annulus surrounding the valve assembly 100.

Figure 4:
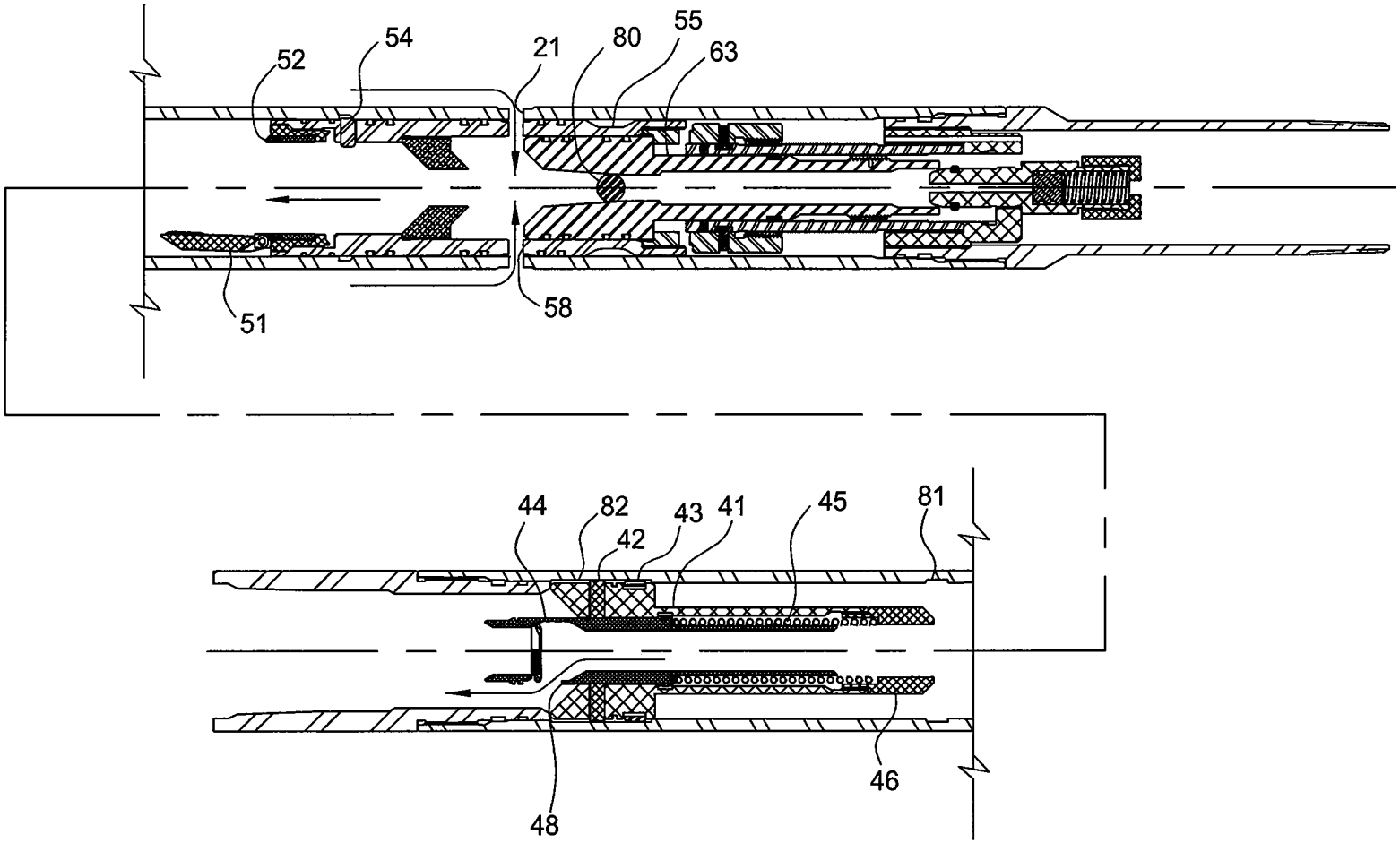
FIG. 4 is a sectional view of the valve assembly in a reverse circulation position after actuation of the locking device according to one embodiment.

When the valve assembly 100 is in the open position, a reverse, pressurized fluid flow may be used to actuate the locking device 40 into an open position to thereby open fluid flow through the valve assembly 100 as illustrated in FIGS. 3 and 4. FIG. 3 illustrates the wellbore fluid flowing into the valve assembly 100 and acting against the flapper valve 47. The pressurized fluid may apply a force sufficient to overcome the resistance of the ring member 43, which resists movement of the upper housing 41, the sleeve member 44, and the flapper valve 47 relative to the outer housing 20. In particular, the pressurized fluid may force the ring member 43 out of the recess 81 formed in the outer housing 20, and move the upper housing 41 in an upward direction until the dog members 42 and/or the ring member 43 move radially outward into another recess 82 formed in the outer housing 20. The upper housing 41 temporarily seals or substantially restricts fluid flow through one or more ports 48 of the sleeve member 44 when secured in the upper housing 41. The dog members 42 are moved from securing the sleeve member 44 within the upper housing 41, such that the biasing member 45 may then move the sleeve member 44 upward relative to the upper housing 41 to open fluid flow through one or more ports 48 of the sleeve member 44 as illustrated in FIG. 4. The ports 48 permit fluid flow around the flapper valve 47 in the opposite direction when moved to a position outside of the upper housing 41.

Figure 5:
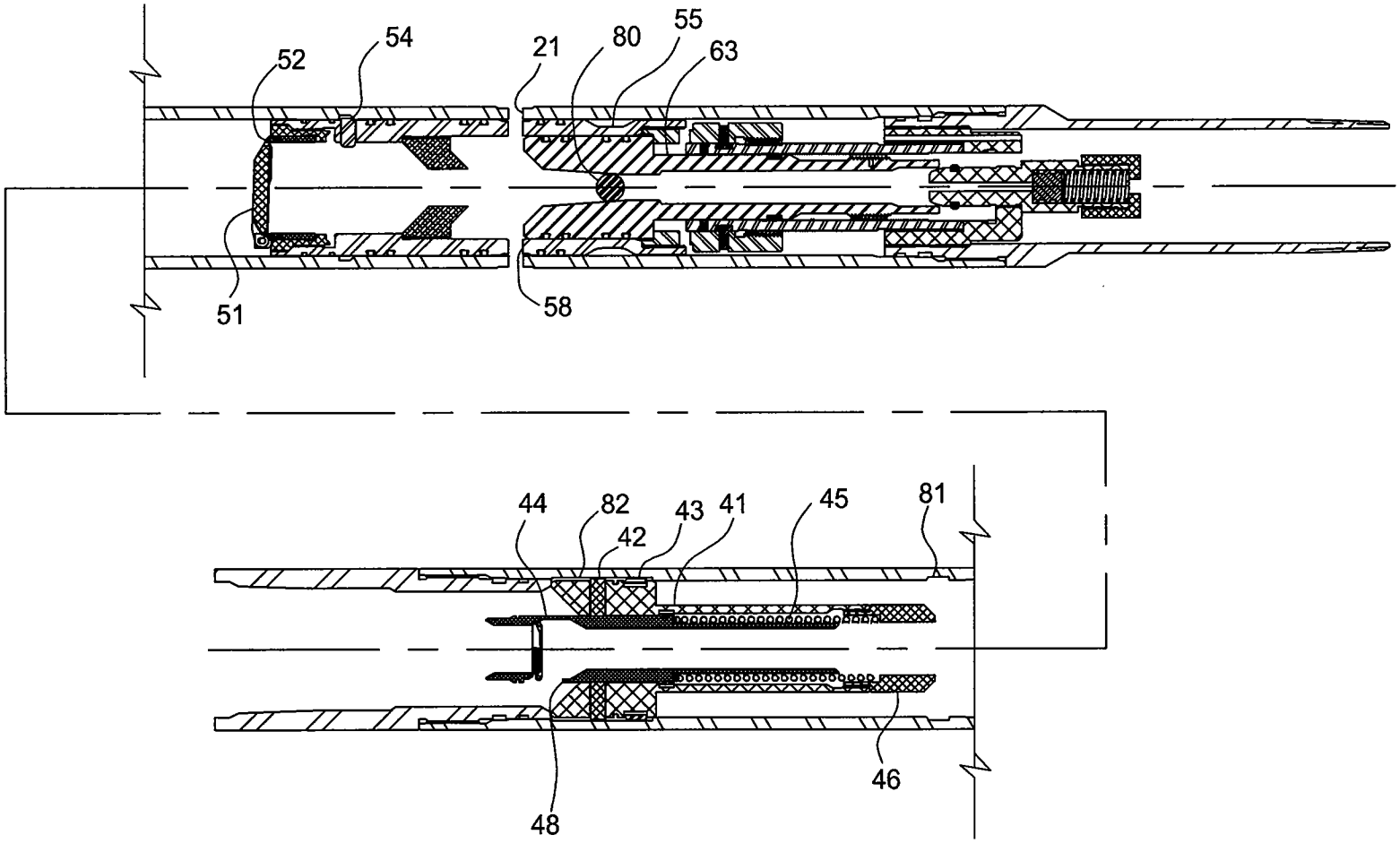
FIG. 5 is a sectional view of the valve assembly after actuation of the locking device and prior to actuation of the valve assembly into a final closed position according to one embodiment.

Once the locking device 40 has been stroked upward, the flapper valve 51 is released and may close against the flapper valve seat 52 (as illustrated in FIG. 5). Reverse fluid flow will lift or open the flapper valve 51 for fluid communication up through the work string as further illustrated in FIG. 4. Also released from engagement with the upper housing 41 and/or the retaining member 46, are the dog members 54 to enable movement of the closing sleeve member 55 as further described below. In one embodiment, the locking device 40 may comprise a rotary-vane releasing disc or member, through which forward fluid flow serves to lock the closing sleeve member 55, but with reverse fluid flow the vanes will allow the disc or member to spin/rotate, thereby releasing the closing sleeve member 55.

Referring to FIG. 4, when that valve assembly 100 is in the open position and the locking device 40 has been actuated, a reverse flow operation, such as a reverse cementing operation, may be conducted. A fluid, such as cement, may be pumped down the annulus to force wellbore fluids into the valve assembly 100 for recovery back to the surface through the work string. The reverse flow may be monitored at the surface to verify that reverse circulation has been achieved. For example, a wellbore conditioning fluid may be continuously pumped down the annulus and monitored at the surface until it returns up through the work string to confirm reverse circulation has been achieved through the valve assembly 100. A predetermined amount of cement may be pumped into the annulus, which circulates the wellbore fluids back to the surface through the valve assembly 100 and work string. The cement may be used to seal the portion of the wellbore annulus above any packers or fracturing sleeves that are coupled to the work string. The amount of cement pumped into the wellbore annulus may be limited so that the cement remains above the wellbore fluids and does not reach the down-hole location of the valve assembly 100 to thereby prevent cement flow through the valve assembly 100 and/or the work string. In one embodiment, a (liner-top) packer may be set, such as by pressurizing the work string after the valve assembly 100 is moved to the final closed position, to maintain the cement in a desired section of the wellbore. The cement may be maintained in a section of the wellbore above the valve assembly 100 and/or any other work string tools, such as other packers and sleeves, needed for conducting subsequent wellbore operations.

FIG. 5 illustrates the valve assembly 100 after actuation of the locking device 40 and prior to moving the valve assembly 100 to the final closed position. When reverse circulation or flow through the valve assembly 100 is stopped, the flapper valve 51 is biased into a closed position by a spring or other biasing member against the flapper valve seat 52. The flapper valve 51 may seal or substantially restrict fluid flow through the closing sleeve member 55 from above. When desired, the work string and the valve assembly 100 above the flapper valve 51 may be pressurized to actuate the valve assembly 100 into the final closed position.

FIG. 6 illustrates the valve assembly 100 in a final closed position. After the reverse flow operation and/or when desired, the valve assembly 100 may be actuated into the final closed position to close fluid communication with the wellbore annulus. Pressurized fluid may be forward circulated/pumped through the work string to the valve assembly 100. The fluid may flow through the flapper valve 47 and/or the ports 48 of the sleeve member 44 to the flapper valve 51. The components of the locking device 40 may be secured to the outer housing 20 by the ring member 43 and/or the dog members 42 engaging the recess 82 when actuating the valve assembly 100 to the final closed position. The pressurized fluid may act on the flapper valve 51, which prevents or substantially restricts forward fluid flow through the valve assembly 100. The fluid pressure may apply a force to the closing sleeve member 55 sufficient to move the dog members 54 out of the recess 83 of the outer housing 20, and release the releasable members 69 to thereby move the closing sleeve member 55 to a position where the seals 56A, 56B seal off fluid communication to the ports 21 in the outer housing 20. As the closing sleeve member 55 is moved downward, the ratchet ring 59 moves along the teeth disposed on the outer surface of the ratchet member 64 and prevents the closing sleeve member 55 from moving back in the opposite or upward direction. When in the final closed position, the closing sleeve member 55 closes fluid communication between the valve assembly 100 and the wellbore, and specifically prevents fluids in the wellbore from flowing into the valve assembly 100.

After the valve assembly 100 is actuated into the final closed position and/or the cementing operation is complete, the inner bore of the work string may be pressurized to actuate one or more other tools coupled to the work string above the valve assembly 100, the other tools including but not limited to packers, fracture sleeves, and/or other valves. For example, after the valve assembly 100 is actuated into the final closed position, the work string may be pressurized to actuate one or more (open hole) packers into engagement with the wellbore to conduct a fracturing operation, and/or one or more (liner-top) packers to maintain the cement within a desired section of the wellbore. The pressurized fluid may also actuate a sleeve or valve to open communication through the work string adjacent an area of interest for conducting the fracturing operation. A fracturing fluid may be supplied through the work string and into the area of interest to conduct the fracturing operation. The fracturing fluid may be prevented from flowing up or down the annulus by the surrounding packers. In one embodiment, one or more of the valve assembly 100 components may be formed from a drillable material, such that the assembly may be drilled out of the wellbore if desired.

Based on the description above, the work string and the valve assembly 100 enable forward circulation through the valve assembly 100 and one or more float (check) valves disposed below, and out the end of the work string when running the assembly into the well. When positioned in the desired location, fluid flow through the valve assembly 100 may be prevented or substantially restricted by dropping the closure member 80 onto the seat of the opening sleeve member 63 to open fluid communication through the ports 21, 58 of the valve assembly 100. Reverse circulation from the annulus through the ports 21, 58 allows cementing of a desired section of the wellbore above the valve assembly 100, and actuates the locking device 40 to release the flapper valve 51 and enable closing of the valve assembly 100. The flapper valve 51 prevents or substantially restricts fluid flow through the valve assembly 100, so that the work string above can be pressurized to move the valve assembly 100 to the final closed position and to actuate one or more other tools coupled to the work string.

Advantages of the embodiments described herein include enabling a cementing operation to be conducted with standard (MZOH) packers and ball actuated fracturing sleeves; and no drill-out operations required between cementing and fracturing, resulting in improved operational efficiencies and cost savings. Other advantages include maintaining the integrity of the work string above all packers and fracturing sleeves, rather than being compromised by a port collar or other similar device which can create a leak path in the work string above the packers; and not requiring cementing of the entire wellbore length, including any horizontal or lateral portions of the wellbore.

While the foregoing is directed to embodiments of the invention, other and further embodiments of the invention may be devised without departing from the basic scope thereof, and the scope thereof is determined by the claims that follow.

The invention claimed is:

1. A valve assembly, comprising:

an outer housing having one or more ports;

a closing sleeve movable in one direction from an open position to a closed position to close fluid flow through the ports;

a locking device operable to temporarily secure the closing sleeve in the open position and movable in an opposite direction to release the closing sleeve for movement to the closed position; and an opening sleeve movable relative to the outer housing to open fluid flow through the ports of the outer housing and into the valve assembly.

2. The valve assembly of claim 1, wherein the closing sleeve includes one or more ports movable into and out of alignment with the ports of the outer housing.

3. The valve assembly of claim 2, wherein the opening sleeve is configured to receive a closure member, and movable in a downward direction using pressurized fluid when the closure member seats in the opening sleeve to thereby open fluid flow through the ports of the closing sleeve.

4. The valve assembly of claim 3, further comprising a ratcheting mechanism operable to permit downward movement of at least one of the closing and opening sleeves, while preventing movement of the at least one closing and opening sleeve in the opposite direction.

5. The valve assembly of claim 1, further comprising one or more dog members disposed through the closing sleeve and secured in a recess of the outer housing by the locking device to temporarily secure the closing sleeve to the outer housing.

6. The valve assembly of claim 1, further comprising a flapper valve coupled to the closing sleeve and temporarily secured in an open position by the locking device.

7. The valve assembly of claim 1, further comprising a hydraulic lock compensation device operable to compensate for hydraulic locking forces from preventing movement of the closing sleeve.

8. The valve assembly of claim 1, wherein the locking device includes a flapper valve coupled to an inner sleeve for allowing fluid flow in one direction while substantially restricting fluid flow in an opposite direction.

9. The valve assembly of claim 8, wherein the locking device further includes an inner housing, and one or more dog members disposed through the inner housing and secured in engagement with the inner sleeve by the outer housing to temporarily secure the inner sleeve to the inner housing.

10. The valve assembly of claim 9, wherein the inner sleeve includes one or more ports configured to permit fluid flow around the flapper valve in the opposite direction when the ports of the inner sleeve are moved to a position outside of the inner housing.

11. The valve assembly of claim 9, wherein the locking device further includes a ring member coupled to the inner housing and engaging a recess in the outer housing to resist movement between the inner and outer housings.

12. The valve assembly of claim 9, wherein the locking device further includes a biasing member operable to move the inner sleeve relative to the inner housing when the dog members are moved into a recess in the outer housing to release the engagement with the inner sleeve.

13. A method of conducting a wellbore operation, comprising:

providing a valve assembly for operation in a wellbore using a work string;

moving an opening sleeve of the valve assembly using pressurized fluid supplied through the work string to open fluid flow through one or more ports;

moving a locking device of the valve assembly using pressurized fluid supplied from an annulus surrounding the valve assembly through the one or more ports to release a closing sleeve of the valve assembly; and moving the closing sleeve using pressurized fluid supplied through the work string to close fluid flow through the one or more ports.

14. The method of claim 13, further comprising dropping a closure member onto the opening sleeve to close fluid flow through the opening sleeve and to generate a fluid pressure through the work string to move the opening sleeve.

15. The method of claim 13, further comprising using a ratchet mechanism to permit movement of at least one of the opening sleeve and the closing sleeve in one direction while preventing movement in an opposite direction.

16. The method of claim 13, further comprising flowing fluid from the annulus through one or more ports of a housing of the valve assembly and through one or more ports of the closing sleeve.

17. The method of claim 13, further comprising moving the locking device to release one or more dog members from engagement with a housing of the valve assembly, wherein the dog members are disposed through the closing sleeve to temporarily secure the closing sleeve to the housing.

18. The method of claim 13, further comprising substantially restricting fluid flow through the locking device using a flapper valve to restrict fluid flow up through the work string.

19. The method of claim 18, further comprising moving an inner sleeve relative to a housing of the locking device to open fluid flow through one or more ports of the inner sleeve for flowing fluid around the flapper valve and up the work string, wherein the housing is configured to temporarily seal or substantially restrict fluid flow through the ports of the inner sleeve.

20. The method of claim 19, further comprising releasing one or more dog members from engagement with the inner sleeve to permit movement of the inner sleeve relative to the housing.

21. The method of claim 13, further comprising releasing a flapper valve to close or substantially restrict fluid flow through the closing sleeve and to generate a fluid pressure through the work string to move the closing sleeve.

22. The method of claim 13, further comprising supplying cement into the annulus to force fluid in the annulus through the one or more ports of the valve assembly.

23. A valve assembly, comprising:

an outer housing having one or more ports;

a closing sleeve movable from an open position to a closed position to close fluid flow through the ports, the closing sleeve temporarily secured in the open position using a fixing member;

a locking device temporarily retaining the fixing member to maintain the closing sleeve in the open position, wherein movement of the locking device in one direction releases the fixing member, thereby enabling the closing sleeve to move in an opposite direction towards the closed position; and an opening sleeve movable relative to the outer housing to open fluid flow through the ports of the outer housing and into the valve assembly.

24. The valve assembly of claim 23, wherein the fixing member includes one or more dog members movably disposed through the closing sleeve and partially disposed in a recess in the housing.

25. The valve assembly of claim 23, wherein the closing sleeve and the locking device are movable using pressurized fluid.

26. A valve assembly, comprising:

an outer housing having one or more ports;

a closing sleeve movable from an open position to a closed position to close fluid flow through the ports;

a locking device operable to temporarily disallow movement of the closing sleeve to the closed position, wherein the locking device is movable in one direction to allow movement of the closing sleeve in an opposite direction to the closed position; and an opening sleeve movable relative to the outer housing to open fluid flow through the ports of the outer housing and into the valve assembly.

27. A valve assembly, comprising:

an outer housing having one or more ports;

a closing sleeve having an open position in which fluid flow through the ports is permitted and a closed position in which fluid flow through the ports is prevented;

a locking device temporarily retaining the closing sleeve in the open position, wherein the locking device is movable in one direction to release the closing sleeve, and wherein the closing sleeve moves in an opposite direction from the open position to the closed position; and an opening sleeve movable relative to the outer housing to open fluid flow through the ports of the outer housing and into the valve assembly.

* * * * *